US007317884B2

(12) United States Patent
Terae et al.

(10) Patent No.: US 7,317,884 B2
(45) Date of Patent: Jan. 8, 2008

(54) IMAGE FORMING APPARATUS FEATURING A DEFINED RELATIONSHIP AMONG AN IMAGE LENGTH, TRANSFORMING MEMBER LENGTH, AND LENGTH OF AN ELECTRIC FIELD AREA

(75) Inventors: Takuya Terae, Abiko (JP); Yuhei Takei, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 11/239,101

(22) Filed: Sep. 30, 2005

(65) Prior Publication Data

US 2006/0083538 A1 Apr. 20, 2006

(30) Foreign Application Priority Data

Oct. 20, 2004 (JP) ..... 2004-306259

(51) Int. Cl.
*G03G 15/16* (2006.01)

(52) U.S. Cl. ..... 399/101

(58) Field of Classification Search ..... 399/98, 399/99, 101, 353, 354
See application file for complete search history.

(56) References Cited

U.S. PATENT DOCUMENTS 5,729,788 A * 3/1998 Hirohashi et al. ..... 399/101 X
5,845,174 A * 12/1998 Yasui et al. ..... 399/101
5,963,769 A 10/1999 Emukai et al. ..... 399/297
6,035,158 A * 3/2000 Asakura et al. ..... 399/101
6,405,002 B2 * 6/2002 Ogiyama et al. ..... 399/101
6,970,666 B2 * 11/2005 Takahashi et al. ..... 399/101
2005/0238382 A1 10/2005 Takei ..... 399/101

FOREIGN PATENT DOCUMENTS

| | | |
|---|---|---|
| JP | 8-314297 | 11/1996 |
| JP | 11-52757 | 2/1999 |
| JP | 11-272087 | 10/1999 |
| JP | 2000-321877 | 11/2000 |
| JP | 2001-337542 | 12/2001 |

* cited by examiner

*Primary Examiner*—Sandra L. Brase
(74) *Attorney, Agent, or Firm*—Fitzpatrick, Cella, Harper & Scinto

(57) ABSTRACT

An image forming apparatus is provided with an image bearing member bearing a toner image thereon, a toner image forming device for forming the toner image on the image bearing member, a transferring member for transferring the toner image borne on the image bearing member to a recording medium being moved, a cleaning member for electrostatically removing the toner adhering to the transferring member, and an electric field forming device for forming an electric field between the transferring member and the cleaning member, wherein when the greatest length of the image formable by the toner image forming device in a direction orthogonal to the direction of movement of the recording medium is defined as L1, and the length of the transferring member is defined as L2, and the length of an area in which the electric field is formed is defined as L3, the relation that L2>L3>L1 is satisfied.

4 Claims, 10 Drawing Sheets

IMAGE FORMING APPARATUS FEATURING A DEFINED RELATIONSHIP AMONG AN IMAGE LENGTH, TRANSFORMING MEMBER LENGTH, AND LENGTH OF AN ELECTRIC FIELD AREA

BACKGROUND OF THE INVENTION

1. Field of the Invention

The invention relates to an image forming apparatus provided with cleaning means for electrostatically removing a toner adhering to transferring means.

2. Description of Related Art

In Japanese Patent Application Laid-open No. H11-52757, there is described a construction as shown in FIG. 11 of the accompanying drawings which mechanically clean transferring means.

A toner image formed on a photosensitive drum 101 is primary-transferred to an intermediate transfer belt 107 stretched around a plurality of rollers 102-106, and thereafter is secondary-transferred onto a recording medium by a secondary transfer roller 109. The secondary transfer roller 109 has its shaft 109*a* supported by a rocking arm 137 which rocks about the center of rocking movement 136. The base end portion of the rocking arm 137 is biased by a tension spring 138, and also is driven by an eccentric cam 139. Thereby, the secondary transfer roller 109 is moved toward and away from the intermediate transfer belt 107. A toner (untransferred toner) adhering to the secondary transfer roller 109 is mechanically wiped off by a cleaning blade 133 brought into contact with the surface of the secondary transfer roller 109.

Also, in Japanese Patent Application Laid-open No. 2001-337542, there is described a construction which, as shown in FIG. 12 of the accompanying drawings, uses electrostatic cleaning for an intermediate transfer belt 208. A toner image formed on a photosensitive belt 201 stretched around rollers 202, 203, 204, and 205 is transferred to the intermediate transfer belt 208 stretched around rollers 209, 210, 211, and 212. Cleaning means 213 is provided on a cleaning area for the intermediate transfer belt 208 formed by a roller 209 as an opposed roller. The cleaning means 213 has a cleaning container 230 fixed to an arm 221 rocking about a shaft 222. In the cleaning container 230, there are disposed a first bias roller 224 and a first fur brush 223 contacting therewith, and a conveying screw 229. A design is made such that the first fur brush 223 and the second fur brush 226 are brought into contact with the intermediate transfer belt 208, and biases of opposite polarities are applied to these to thereby remove a toner on the intermediate transfer belt 208.

However, in the construction described in the above-mentioned Japanese Patent Application Laid-open No. H11-52757, the secondary transfer roller 109 is abraded by the frictional contact of the cleaning blade therewith with the long-term use and therefore, faulty transfer occurs. Also, it is difficult to reliably remove the untransferred toner electrostatically adhering to the secondary transfer roller by the cleaning blade.

On the other hand, in the construction described in Japanese Patent Application Laid-open No. 2001-337542, cleaning biases are applied to the cleaning means and therefore, it is difficult to prevent leakage of the biases to other members and yet, effect good cleaning.

When the cleaning of the transferring means is not effected sufficiently, there occurs the so-called back contamination in which the toner adheres to the back of the recording medium.

SUMMARY OF THE INVENTION

It is an object of the present invention to provide an image forming apparatus in which a toner adhering to cleaning means can be electrostatically well removed.

Also, it is an object of the present invention to provide an image forming apparatus having:

- an image bearing member bearing a toner image thereon;
- toner image forming means for forming the toner image on the image bearing member;
- a transferring member for transferring the toner image borne on the image bearing member to a recording medium;
- a cleaning member for electrostatically removing a toner adhering to the transferring member; and
- electric field forming means for forming an electric field between the transferring member and the cleaning member,
- wherein when the greatest length of the image formable by the toner image forming means is defined as L1, and the length of the transferring member is defined as L2, and the length of an area in which the electric field is formed is defined as L3, the relation that L2>L3>L1 is satisfied.

DETAILED DESCRIPTION OF THE PREFERRED EMBODIMENTS

Figure 1:
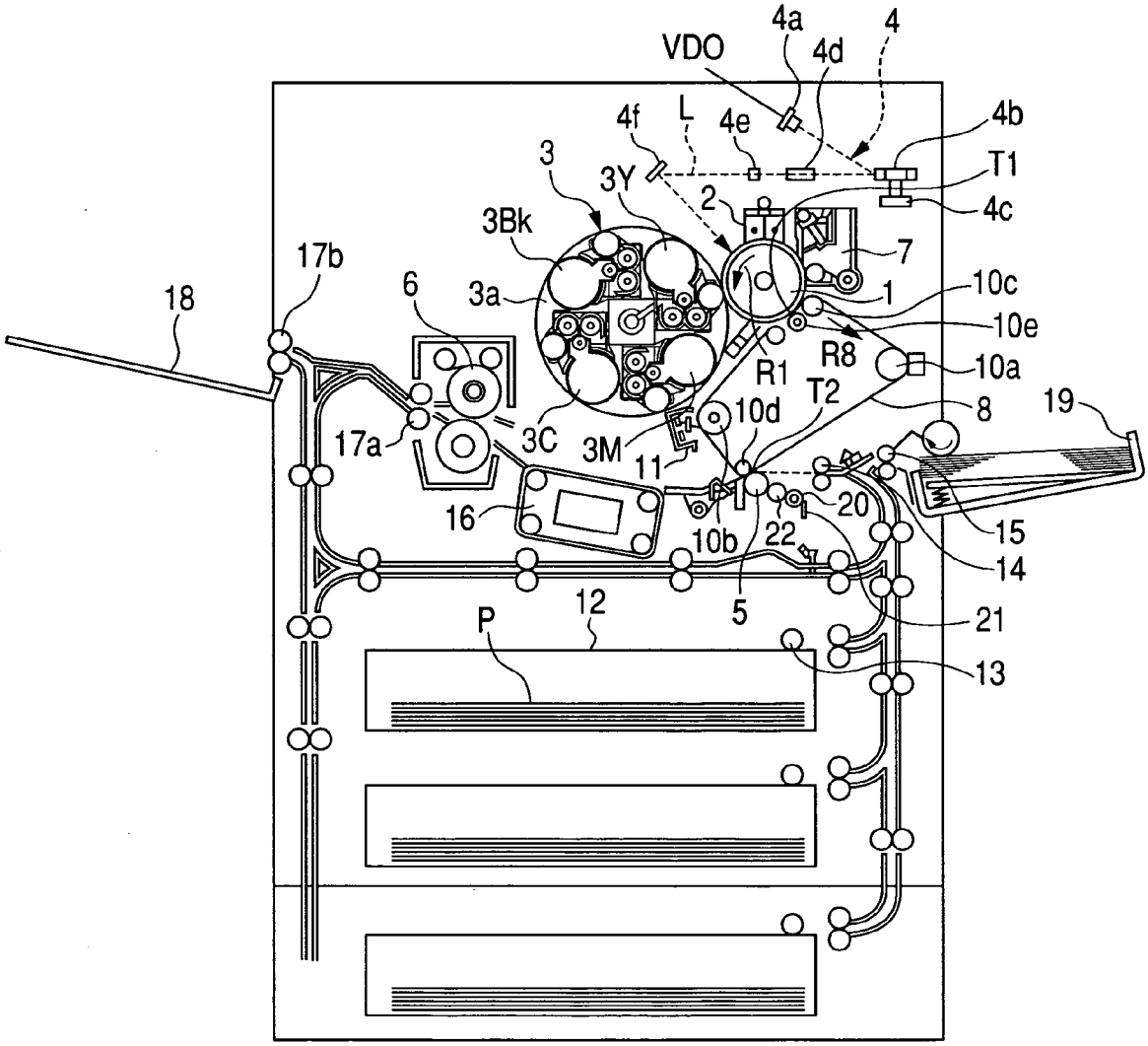
FIG. 1 is a longitudinal cross-sectional view schematically showing the construction of an image forming apparatus to which the present invention can be applied and as it is seen from its front side.

In the present invention a design is made such that when the maximum length of an image formable by toner image forming means is defined as L1, and the width of a transferring member is defined as L2, and the length of an area in which an electric field is formed is defined as L3, L1, L2 and L3 satisfy L2>L3>L1.

Thereby, leakage can be prevented from occurring on the end portions of the transferring member and a cleaning member to thereby effect reliable and good cleaning.

Some embodiments of the present invention will hereinafter be described with reference to the drawings. Throughout the drawings, like reference characters designate members similar in construction or action, and a duplicate description of these is suitably omitted.

Embodiment 1

FIG. 1 shows an image forming apparatus to which the present invention can be applied. The image forming apparatus shown in FIG. 1 is a four-color full-color printer of an electro-photographic type and an intermediate transfer member type, and FIG. 1 is a longitudinal cross-sectional view schematically showing the construction of this printer (hereinafter referred to as the "image forming apparatus") as it is seen from its front side.

The image forming apparatus shown in FIG. 1 is provided with a photosensitive drum (image bearing member) 1. Around the photosensitive drum 1, there are disposed a primary charger (charging means) 2 for charging the surface of this photosensitive drum 1, an exposing apparatus (exposing means) 4 for forming an electrostatic latent image on the surface of the photosensitive drum 1 after being charged, a developing apparatus (developing means) 3 for developing the electrostatic latent image as a toner image, an intermediate transfer belt (intermediate transfer member and image bearing member) 8 to which the toner image on the photosensitive drum 1 is transferred, and a cleaning apparatus (drum cleaning means) 7 for removing any untransferred toner. Also, a sheet supplying cassette 12, a sheet feeding roller 13, registration rollers 14, a secondary transfer roller (transferring means or transferring member) 5, a conveying belt 16, a fixing apparatus 6, conveying rollers 17*a* and 17*b* and a sheet discharging tray 18 are disposed along the conveying direction of a recording medium P (e.g. paper or transparent film) which is a medium to which the image is to be transferred, in succession from an upstream side.

The schematic operation of the image forming apparatus of the above-described construction is as follows. A yellow (Y) toner image is formed on the photosensitive drum 1 by charging, exposure and development, and this toner image is primary-transferred onto the intermediate transfer belt 8. A similar process is repeated for each of the remaining three colors, i.e., magenta (M), cyan (C) and black (Bk), and toner images of the four colors are superposed on the intermediate transfer belt 8. These toner images of the four colors are collectively secondary-transferred onto the recording medium P, and thereafter are fixed thereon. Thereby, there is formed a four-color full-color image. A further description of the foregoing image forming apparatus will be made in detail hereinafter.

As shown in FIG. 1, the image forming apparatus is provided with a drum-shaped electrophotographic photosensitive member (photosensitive drum) 1 as an image bearing member. The photosensitive drum 1 is rotatively driven at a predetermined process speed (peripheral speed) in the direction indicated by the arrow R1 by driving means (not shown).

The surface of the photosensitive drum 1 is uniformly charged to a predetermined polarity and predetermined potential by the primary charger 2. The primary charger 2 shown in FIG. 1 is constituted by a corona charger.

An electrostatic latent image is formed on the uniformly charged photosensitive drum 1 by the exposing apparatus 4. The exposing apparatus 4 has a laser unit 4*a* emitting a laser beam L, a polygon mirror 4*b* for causing the laser beam L to scan horizontally, a scanner motor 4*c* for rotating the polygon mirror 4*b* at a high speed, an fθ lens 4*d* for imaging the laser beam L, a detector 4*e* for detecting a BD signal indicative of a horizontal scanning start point, and a reflecting mirror 4*f* for directing the laser beam L to the photosensitive drum 1. Also, the laser beam L is ON/OFF-modulated by an image signal (VDO signal) which is the input signal of the laser unit 4*a*.

The exposing apparatus 4 is such that an image writing-out position determined with the transferring position when the toner images on the photosensitive drum 1 are transferred onto the intermediate transfer belt 8 as an intermediate transfer member taken into account is detected by the above-mentioned detector 4*e*, and in synchronism with a reference signal (TOP signal) from this detector 4*e*, the laser beam L modulated by the image signal (VDO signal) scans on the photosensitive drum 1 and exposes it thereto. Thereby, an electrostatic latent image corresponding to the first color, i.e., yellow, image signal (VDO signal) is formed on the photosensitive drum 1.

The electrostatic latent image formed on the photosensitive drum 1 is developed by the developing apparatus 3. The developing apparatus 3 has a rotatable rotary 3*a*, and four developing devices of the four colors carried thereon, i.e., developing devices 3Y, 3M, 3C and 3Bk containing yellow (Y), magenta (M), cyan (C) and black (Bk) developers, respectively, therein. The developing apparatus 4 is such that a developing device of a color to be used for development is disposed at a developing position opposed to the surface of the photosensitive drum 1 by the rotation of the rotary 3*a*. In FIG. 1, the first color, i.e., yellow, developing device 4Y is disposed at the developing position. The electrostatic latent image on the photosensitive drum 1 has a toner attached thereto by this developing device 4Y, and is developed as a yellow toner image.

The toner image thus formed on the photosensitive drum 1 is transferred onto the intermediate transfer belt 8 as the intermediate transfer member. The intermediate transfer belt 8 is stretched around a drive roller 10*a*, a driven roller 10*b*, a tension roller 10*c* and a secondary transfer opposed roller 10*d*, and is urged against the surface of the photosensitive drum 1 by a primary transfer roller 10*e*. Thereby, a primary transferring portion (primary transferring nip portion) T1 is formed between the photosensitive drum 1 and the intermediate transfer belt 8. The intermediate transfer belt 8 is rotatively driven in the direction indicated by the arrow R8 at substantially the same speed as the process speed of the photosensitive drum 1 by the rotation of the drive roller 10*a*. The above-described yellow toner image formed on the photosensitive drum 1 is primary-transferred onto the intermediate transfer belt 8 in the primary transferring portion T1 by a primary transferring bias opposite in polarity to the toner being applied to the primary transfer roller 10*e*.

From the photosensitive drum 1 after the transfer of the toner image, any toner not transferred to the intermediate transfer belt 8 during the primary transfer but remaining on the surface of the drum 1 (primary-untransferred toner) is removed by the cleaning apparatus 7, and the photosensitive drum 1 is used for the formation of the next magenta image.

Steps similar to those carried out for yellow, i.e., charging, exposing, developing, primary transfer and cleaning are repetitively carried out also for the remaining three colors, and toner images of the four colors are superposed one upon another on the intermediate transfer belt 8.

Further, the recording medium P contained in the sheet supplying cassette 12 is fed by the sheet feeding roller 13 at a desired timing based on a reference signal (TOP signal) from the detector 4*e*, is conveyed to the registration rollers 14 by the conveying rollers, and is once stopped. Then, the recording medium P is supplied to a secondary transferring portion T2 by the registration rollers 14 in such a manner as to be timed with the toner images on the intermediate transfer belt 8. Here, the secondary transferring portion T2 is formed between the intermediate transfer belt 8 and the secondary transfer roller 5 disposed at a location corresponding to the above-mentioned transfer opposed roller 10*d* on the surface side of the intermediate transfer belt 8. The secondary transfer roller 5 is designed to be movable toward and away from the intermediate transfer belt 8, and is spaced apart from the intermediate transfer belt 8 until the toner images of the four colors are transferred onto the intermediate transfer belt 8. The recording medium P supplied to this secondary transferring portion T2 has the toner images of the four colors on the intermediate transfer belt 8 collectively secondary-transferred to its surface in the secondary transferring portion T2 by a secondary transferring bias being applied to the secondary transfer roller 5.

The recording medium P now having the toner images transferred to its surface is conveyed to the fixing apparatus 6 by a conveying belt 16, is heated and pressurized there, and the toner images of the four colors are fused and fixed on the surface thereof. The recording medium P after the fixing of the toner images is discharged onto and stacked on a sheet discharging tray 18 by the conveying rollers 17*a* and 17*b*. Thereby, the formation of a four-color full-color image on one side of the recording medium P is completed.

On the other hand, from the intermediate transfer belt 8 after the transfer of the toner images, the toners not transferred to the recording medium P but residual on the surface thereof (secondary-untransferred toners) are removed by a belt cleaner 11. Also, the toners adhering to the secondary transfer roller 5 are removed by a scraping member 21 such as a fur brush (or a fur brush roller) 22 and an electrostatic roller 20. Also, a design is made such that the use of a multi-sheet feeding tray 19 and a sheet feeding roller 15 enables the feeding of a plurality of kinds of recording mediums P to be effected.

Figure 2:
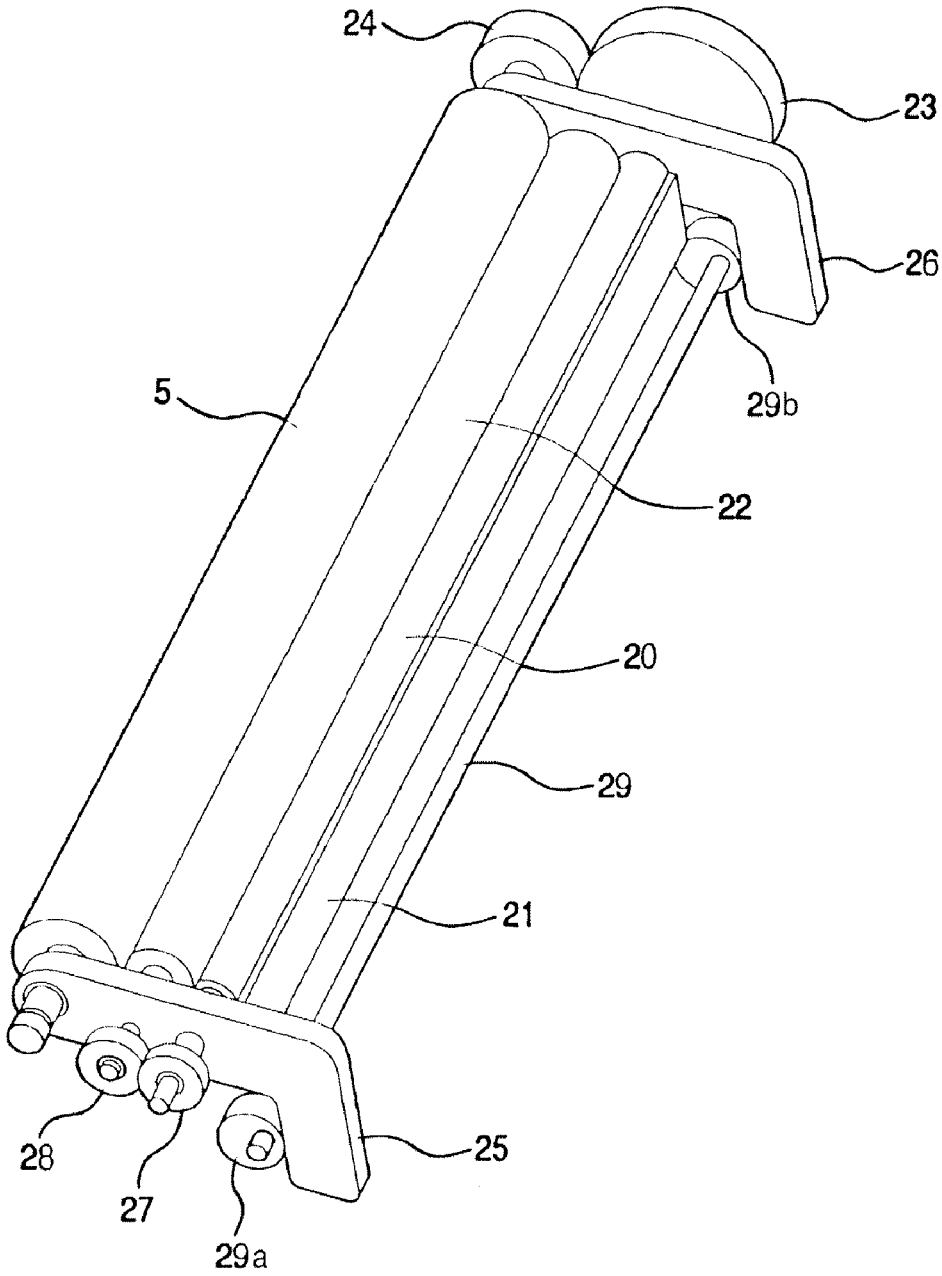
FIG. 2 is a perspective view showing the construction of a cleaning member for cleaning a secondary transfer roller.
Figure 3:
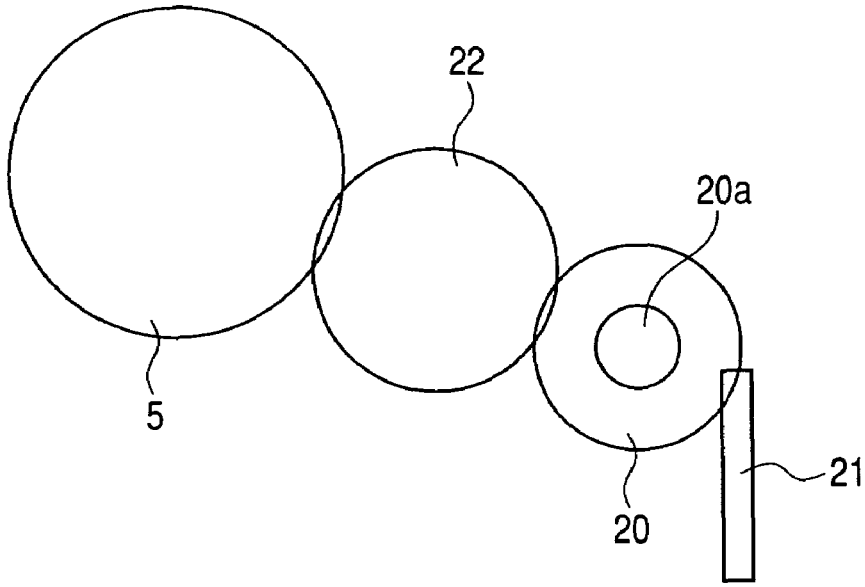
FIG. 3 is a longitudinal cross-sectional view of the cleaning member.

As described above, near the secondary transferring portion T2, there are disposed the secondary transfer opposed roller 10*d* and the secondary transfer roller 5 for secondary-transferring the toner images on the intermediate transfer belt 8 to the recording medium P, and as shown in FIGS. 2 and 3, there are disposed the fur brush (cleaning member) 22 for collecting the toners on the secondary transfer roller 5, the electrostatic roller 20 for collecting the toners adhering to this fur brush 22, and the scraping member 21 for scraping off the toners adhering to this electrostatic roller 20. Here, the fur brush 22 is in contact with the secondary transfer roller 5. Also, the electrostatic roller 20 is in contact with the fur brush 22. Further, the scraping member 21 is in contact with the electrostatic roller 20.

Figure 4:
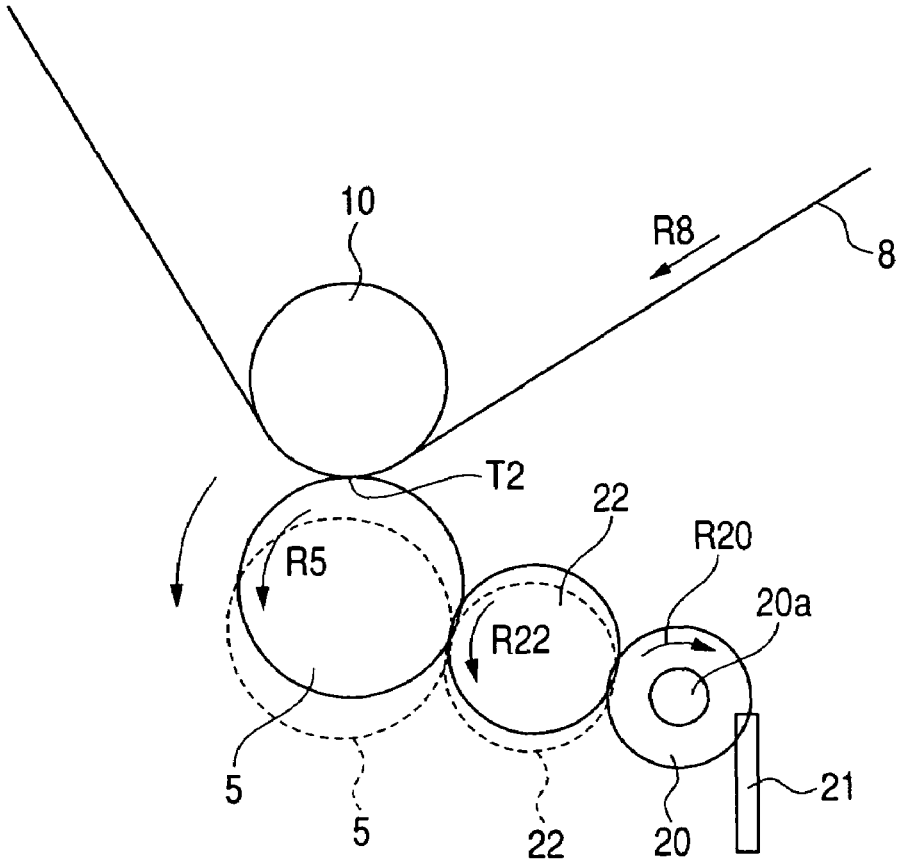
FIG. 4 illustrates the operations of the secondary transfer roller and the cleaning member.

As shown in FIG. 2, the secondary transfer roller 5 has its opposite end portions supported by rocking arms 25 and 26, and likewise the fur brush 22 and the electrostatic roller 20 also have their opposite end portions supported by the rocking arms 25 and 26. These rocking arms 25 and 26 are made rockable in a substantially vertical direction about the shaft 20*a* of the electrostatic roller 20. Eccentric cams 29*a* and 29*b* about against the base end sides of the rocking arms 25 and 26. These eccentric cams 29*a* and 29*b* are rotated about a shaft 29 by a motor (not shown), whereby the rocking arms 25 and 26 have their distal end sides rocked in a substantially vertical direction about the shaft 20*a*. With this rocking movement of the rocking arms 25 and 26, as shown in FIG. 4, the secondary transfer roller 5 and the fur brush 22 are rocked to positions indicated by solid lines and positions indicated by dotted lines. Thereby, the secondary transfer roller 5 is rocked between an operative position (solid line) in which it contacts with the intermediate transfer belt 8 and a retracted position (dotted line) in which it is spaced apart from the intermediate transfer belt 8. That is, the secondary transfer roller 5 is moved toward and away from the intermediate transfer belt 8 by the rocking movement of the rocking arms 25 and 26 by the rotation of the motor. When the four-color full-color image is to be formed, this secondary transfer roller 5 remains spaced apart from the intermediate transfer belt 8 until the toner image of the last color is primary-transferred from the photosensitive drum 1 to the intermediate transfer belt 8. When the toner image of the last color is being primary-transferred from the photosensitive drum 1 to the intermediate transfer belt 8, the secondary transfer roller 5 is brought into contact with the intermediate transfer belt 8 so that secondary transfer may be effected.

A gear 23 driven by a driving motor (not shown) is fixed to one end portion of the shaft of the above-described electrostatic roller 20, and a gear 27 is fixed to the other end portion thereof. The gear 23 is in meshing engagement with a gear 24 fixed to one end portion of the shaft of the secondary transfer roller 5, and the gear 27 is in meshing engagement with a gear 28 fixed to the other end portion of the fur brush 22. Thereby, when the gear 23 is rotated by the driving motor, the electrostatic roller 20 is rotated in the direction indicated by the arrow R20 in FIG. 4, and through the gear 4, the secondary transfer roller 5 is rotated in the direction indicated by the arrow R5. Further, the rotation of the electrostatic roller 21 is transmitted to the fur brush 22 through the gears 27 and 28, whereby the fur brush 22 is rotated in the direction indicated by the arrow R22. As described above, the electrostatic roller 20 is rotated by the rotation of the driving motor, and the secondary transfer roller 5 and the fur brush 22 are rotated in a direction opposite to the rotation direction of the electrostatic roller 20. Accordingly, the secondary transfer roller 5 and the fur brush 22 are adapted to be rotated in the same direction.

The secondary transfer roller 5 is designed to be rotated with the fur brush 22 and the electrostatic roller 20 for a predetermined time before it is brought into contact with the intermediate transfer belt 8, whereby cleaning is effected. Also, after being spaced apart from the intermediate transfer belt 8, the secondary transfer roller 5 is likewise rotated with the fur brush 22 and the electrostatic roller 20 for a predetermined time, whereby cleaning is effected.

A method of cleaning the secondary transfer roller 5 will now be described in detail. The toners transferred onto the intermediate transfer belt 8 have a certain polarity, and further are transferred to the recording medium P by a bias being-applied to the secondary transfer opposed roller 10*d* when secondary transfer is effected. Consequently, the untransferred toners present on the secondary transfer roller 5 are toners having substantially the same polarity.

Figure 5A:
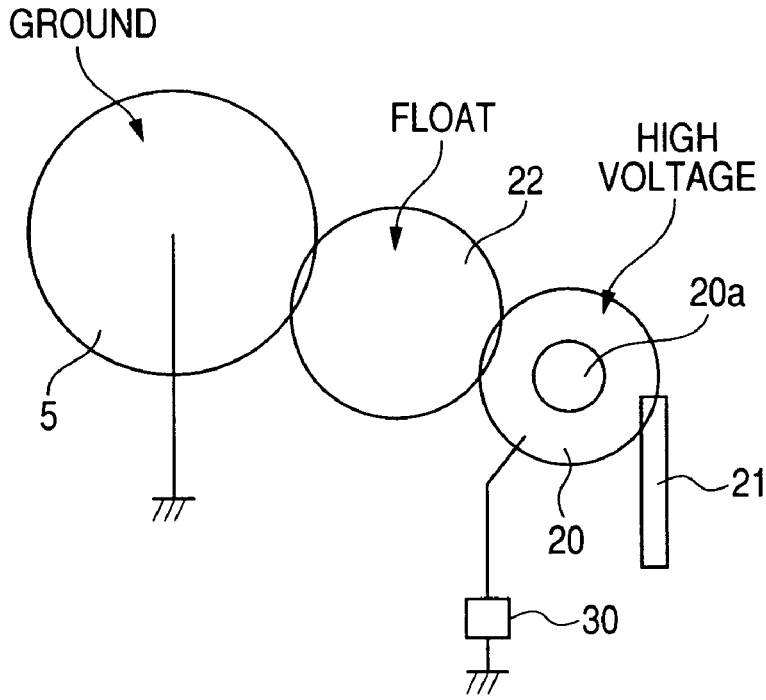
FIGS. 5A and 5B illustrate the electrical constructions of the secondary transfer roller and the cleaning member.

The electrical construction of the vicinity of the secondary transferring portion T2 will be described here with reference to FIGS. 5A and 5B. As shown in FIG. 5A, the secondary transfer roller 5 is electrically grounded, the fur brush 22 electrically floats, and a bias opposite in polarity to the untransferred toners present on the secondary transfer roller 5 is applied to the electrostatic roller 20. The bias is applied from an electrostatic roller power supply 30 (electric field forming means) which is a voltage source to the electrostatic roller 20. Then, an electric field is formed between the secondary transfer roller 5 and the fur brush 22. By the action of this electric field, the toners adhering to the secondary transfer roller 5 is electrostatically removed onto the fur brush 22.

Figure 5B:
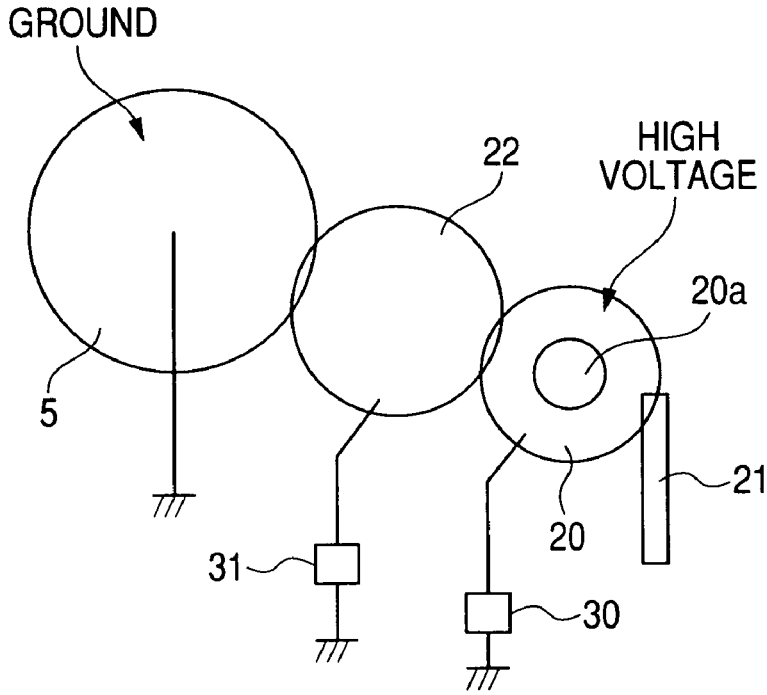

Also, a method shown in FIG. 5B is possible as the method of forming an electric field between the secondary transfer roller 5 and the fur brush 22. That is, as shown in FIG. 5B, the secondary transfer roller 5 is electrically grounded. A bias opposite in polarity to the untransferred toners present on the secondary transfer roller 5 is applied to the fur brush 22. The bias is applied from a fur brush power supply 31 (electric field forming means) which is a voltage source to the fur brush 22.

Figure 6:
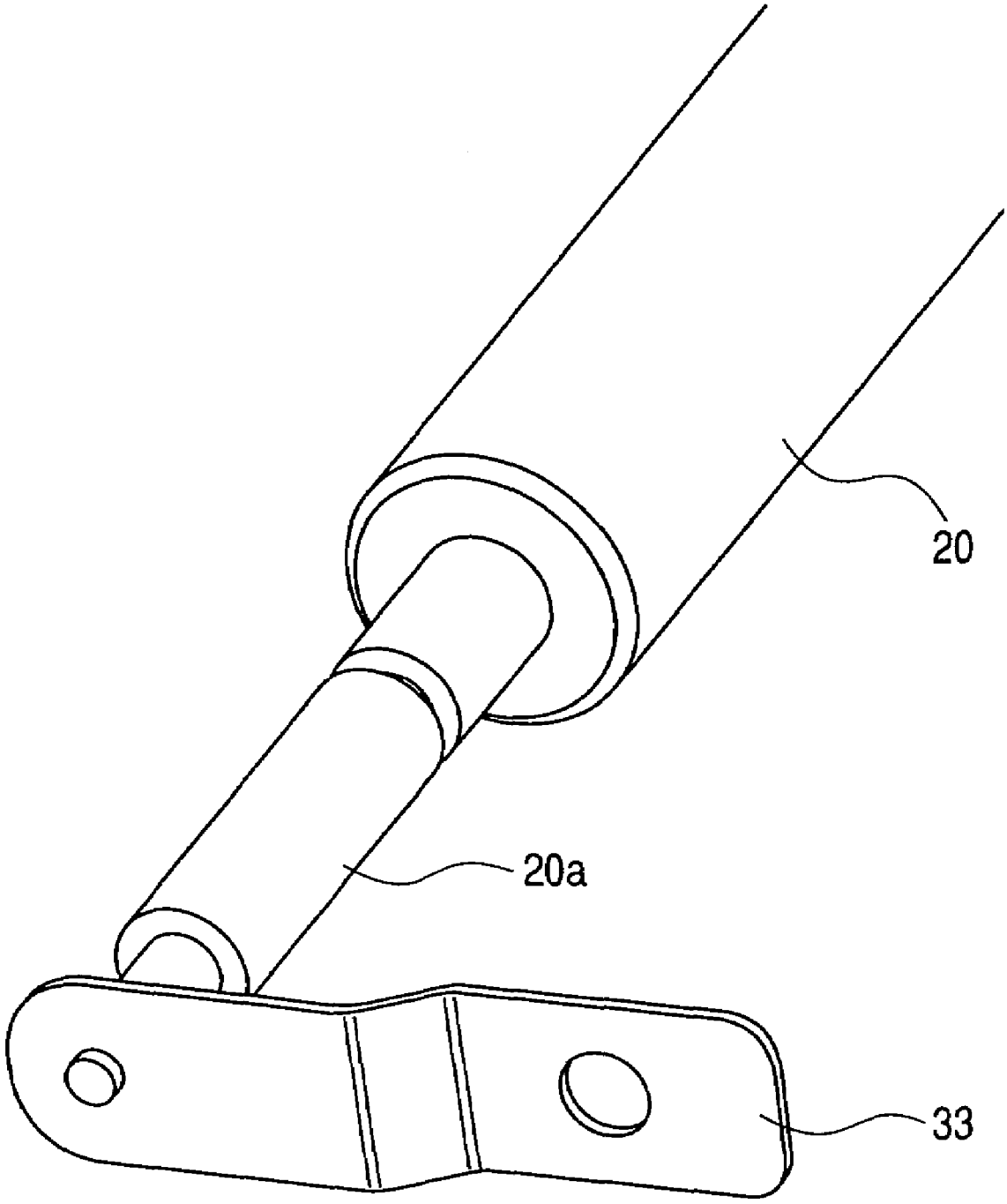
FIG. 6 is a perspective view illustrating a construction for supplying electricity to an electrostatic roller.

Here, the secondary transfer roller 5 rocks with the shaft 20*a* of the electrostatic roller 20 as a fulcrum and therefore, when high voltage is to be inputted to the electrostatic roller 20, it becomes easily possible to input the high voltage from the end portion of the shaft 20*a* by a leaf spring 33 by the use of a heretofore well-known method, as shown in FIG. 6.

Figure 7A:
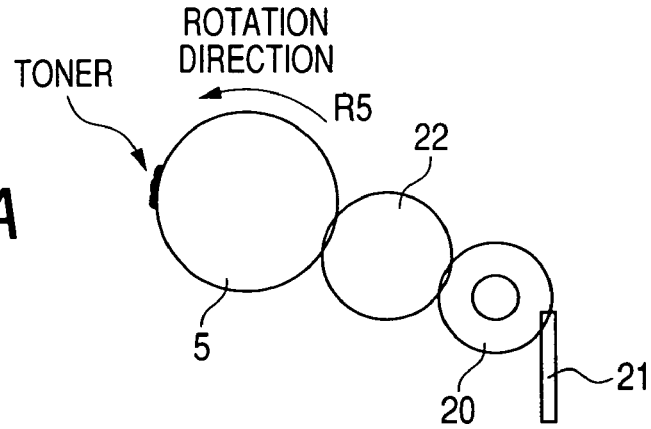
FIGS. 7A, 7B, 7C and 7D illustrate the operation of removing a toner adhering to the secondary transfer roller.
Figure 7B:
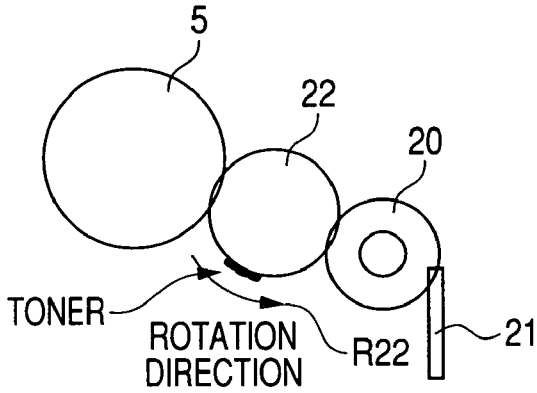
Figure 7C:
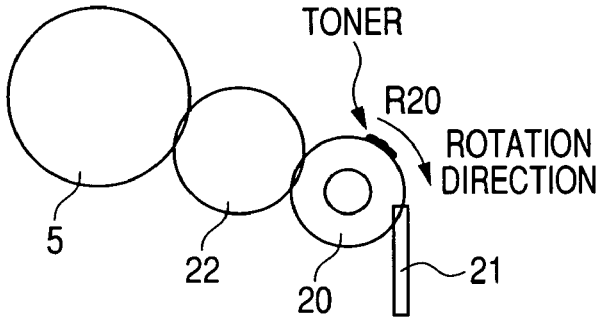
Figure 7D:
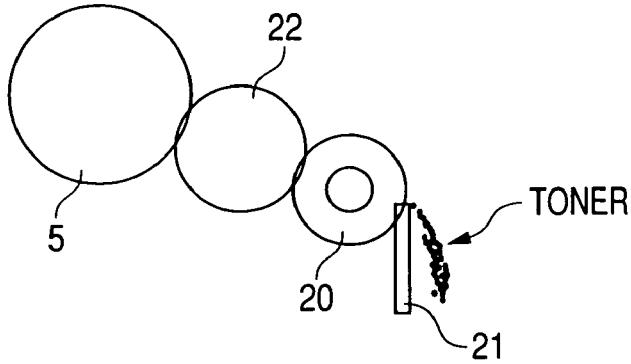

FIGS. 7A, 7B, 7C and 7D show the flow of the toners during the cleaning of the secondary transfer roller 5. The untransferred toners adhering onto the secondary transfer roller 5 are first electrostatically collected by the fur brush 22 with the rotation of the secondary transfer roller 5 in the direction indicated by the arrow R5, as shown in FIGS. 7A and 7B. Thereafter, by the rotation of the fur brush 22 in the direction of R22, the toners are collected by the electrostatic roller (collecting member) 20, as shown in FIG. 7C. Then, as shown in FIG. 7D, the toners are scraped off and removed by the scraping member (removing member) 21 which is in contact with the electrostatic roller 20. The toners scraped off from the electrostatic roller 20 are carried by toner carrying means (not shown). Instead of providing the toner carrying means, a toner collecting portion may be provided substantially below the secondary transferring portion so as to collect the toners therein. Here, the scraping member 21 is in contact with the electrostatic roller 20, and since the scraping member 21 itself need not be rocked, the positional accuracy of the scraping member 21 can be improved.

Figure 8:
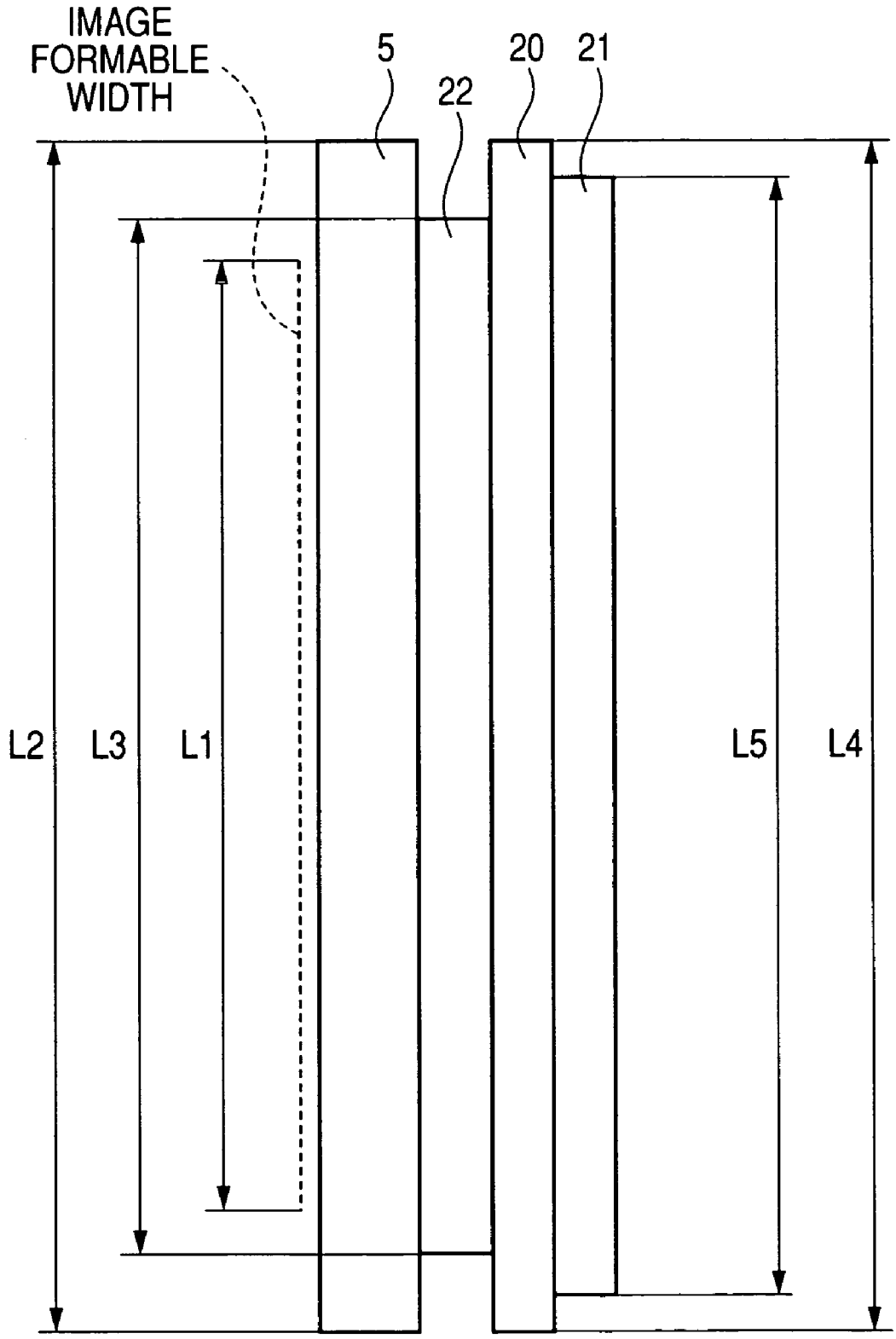
FIG. 8 illustrates an image formable width L1, the width L2 of the secondary transfer roller, the width L3 of a fur brush (the width of an area in which an electric field is formed), the width L4 of the electrostatic roller, and the width L5 of a scraping member.

The construction of the thrust length (the length in a direction along the shaft of the secondary transfer roller 5, hereinafter referred to as the "width") of the secondary transferring portion T2 will be described here with reference to FIG. 8. First, the fur brush 22 is such that the width L3 thereof is narrower than the width L2 of the secondary transfer roller 5 (L2>L3), and with regard to the positions of the fur brush 22 and the secondary transfer roller 5 in the width direction thereof, the fur brush 22 is disposed so that the width L3 thereof may be within the width L2 of the secondary transfer roller 5. Thereby, the bias applied to the electrostatic roller 20 is prevented from leaking to the opposite end portions of the secondary transfer roller 5 through the fur brush 22. Here, the fur brush 22 has the entire area of its width L3 formed of an electrically conductive material. Accordingly, the width of the electric field formed between the secondary transfer roller 5 and the fur brush 22 by the bias applied to the electrostatic roller 20 becomes the same length as the width L3 of the fur brush 22.

Also, the fur brush 22 is disposed so that the width L3 thereof may be wider than an image formable width L1 (L3>L1) and the image formable width L1 may be within the width (the width of the area in which the electric field is formed) L3 of the fur brush 22. Thereby, the bias applied to the electrostatic roller 20 is prevented from interfering with the bias applied to the secondary transfer opposed roller 10*d* through the fur brush 22 to thereby cause unevenness to the toner images transferred onto the recording medium P.

That is, the relation among the image formable width L1, the width L2 of the secondary transfer roller 5 and the width (the width of the area in which the electric field is formed) L3 of the fur brush 22 becomes as follows:

L2>L3>L1

Also, it is desirable that the relation between the image formable width L1 and the width (the width of the area in which the electric field is formed) L3 of the fur brush 22 is L3−L1>0.5 [mm]

Figure 9A:
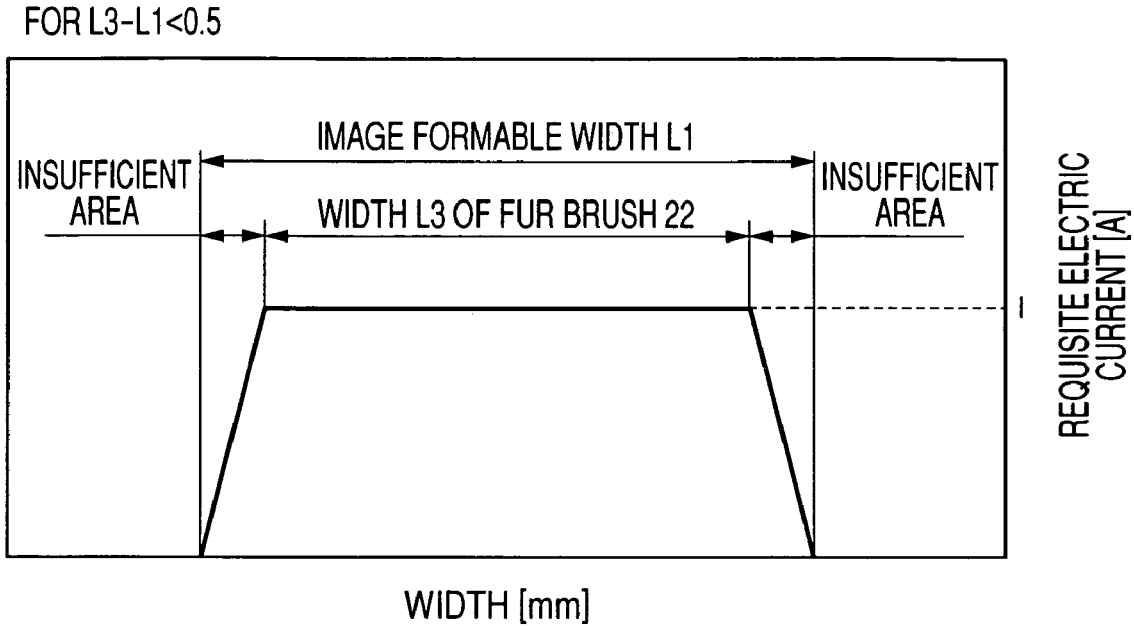
FIGS. 9A and 9B illustrate the relation of an electric current in a secondary transferring portion.

This was found by an experiment. When as shown in FIG. 9A, the relation between the image formable width L1 and the width (the width of the area in which the electric field is formed) L3 of the fur brush 22 is L3−L1<0.5 [mm], the bias applied to the electrostatic roller 20 interferes with the bias applied to the secondary transfer opposed roller 10*d*, through the fur brush 22, and an electric current I[A]0 necessary for secondary transfer is not obtained at the opposite end portions of the image formable width L1.

Figure 9B:
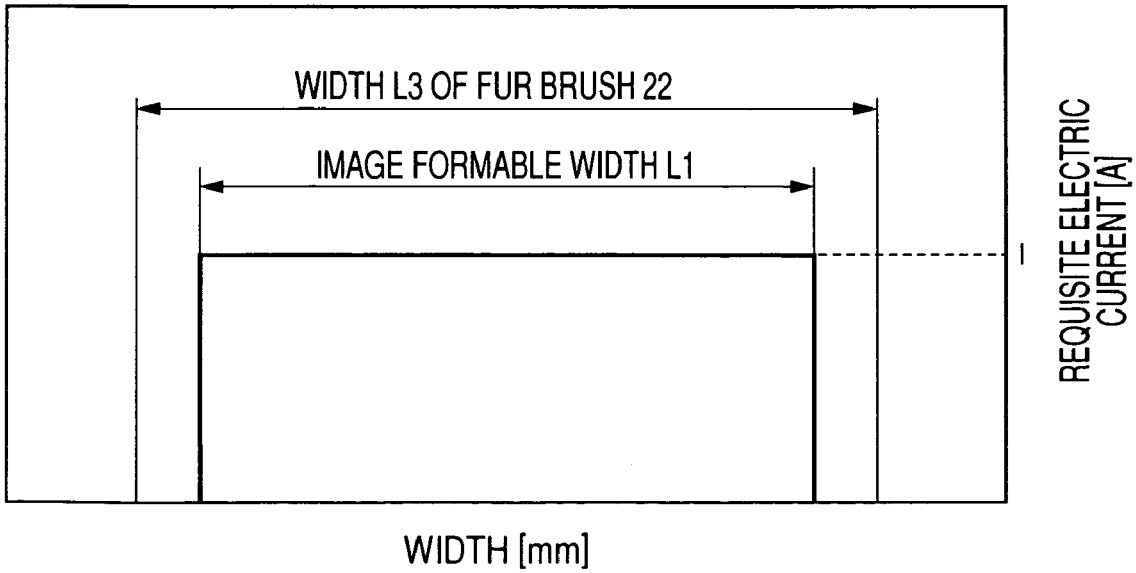

In contrast, it has been found that when as shown in FIG. 9B, the relation between the image formable width L1 and the width (the width of the area in which the electric field is formed) L3 of the fur brush 22 is L3−L1>0.5 [mm], the bias applied to the electrostatic roller 20 does not interfere with the bias applied to the secondary transfer opposed roller 10*d*, through the fur brush 22, but the electric current I[A]0 necessary for secondary transfer is obtained at the opposite end portions of the image formable width L1.

Further, the electrostatic roller 20 is disposed so that the width L4 thereof may be wider than the width (the width of the area in which the electric field is formed) L3 of the fur brush 22 (L4>L3), and the width (the width of the area in which the, electric field is formed) L3 of the fur brush 22 may be within the width L4 of the electrostatic roller 20. Thereby, the untransferred toners adhering onto the secondary transfer roller 5 electrostatically collected by the fur brush 22 can be reliably collected onto the electrostatic roller 20.

Next, the scraping member 21 is disposed so that the width L5 thereof may be narrower than the width L4 of the electrostatic roller 20 (L5<L4), and the width L5 of the scraping member 21 may be within the width L4 of the electrostatic roller 20. Thereby, the scraping member 21 can contact with the electrostatic roller 20 with uniform pressure in the width direction thereof. Also, the scraping member 21 is disposed so that the width L5 thereof may be wider than the width (the width of the area in which the electric field is formed) L3 of the fur brush 22 (L5>L3), and the width (the width of the area in which the electric field is formed) L3 of the fur brush 22 may be within the width L5 of the scraping member 21. Thereby, the untransferred toners collected onto the electrostatic roller 20 can be reliably scraped off by the scraping member 21.

That is, the relation among the width (the width of the area in which the electric field is formed) L3 of the fur brush 22, the width L4 of the electrostatic roller 20 and the width L5 of the scraping member 21 becomes as follows:

L4>L522 L3

As described above, in the image forming apparatus wherein the untransferred toners adhering onto the secondary transfer roller 5 are electrostatically removed, the thrust lengths of the secondary transfer roller 5, the fur brush 22 (the width of the area in which the electric field is formed), the electrostatic roller 20 and the scraping member 21 are optimally set relative to the image formable width L1, whereby the secondary transfer roller 5 can be reliable cleaned and the back contamination of the recording medium P can be effectively prevented.

Figure 10:
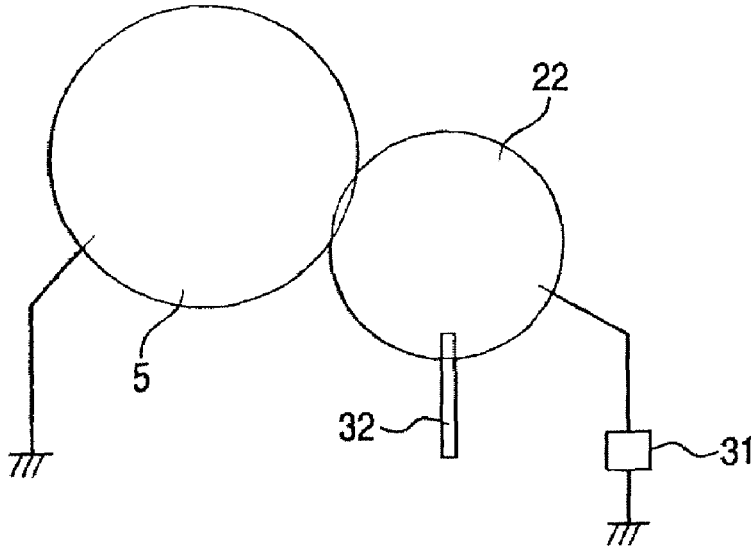
FIG. 10 is a longitudinal cross-sectional view illustrating another construction of the present invention.
Figure 11:
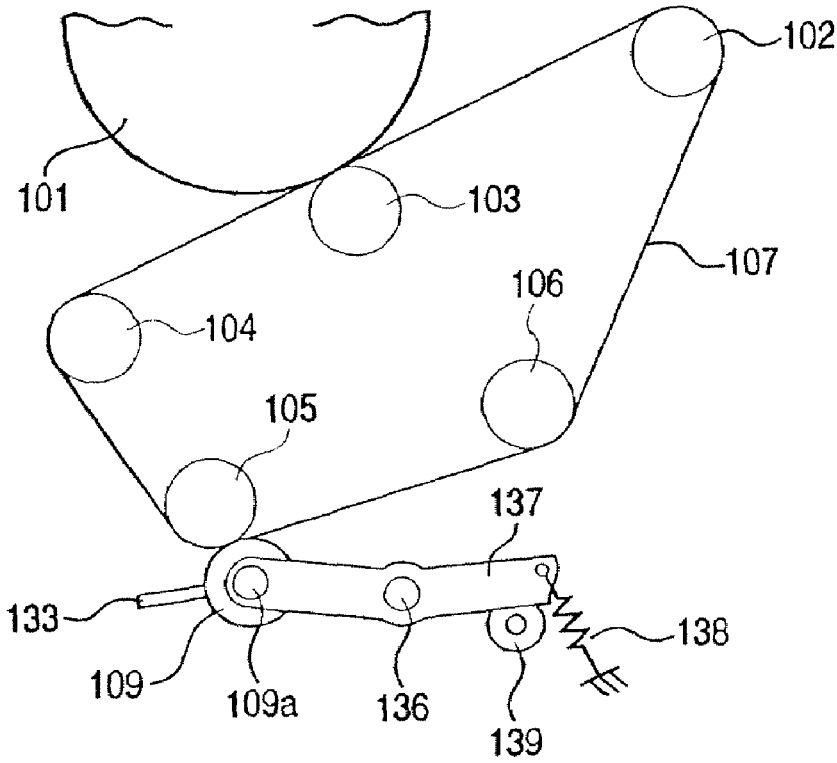
FIG. 11 PRIOR ART
FIG. 11 illustrates conventional cleaning means.
Figure 12:
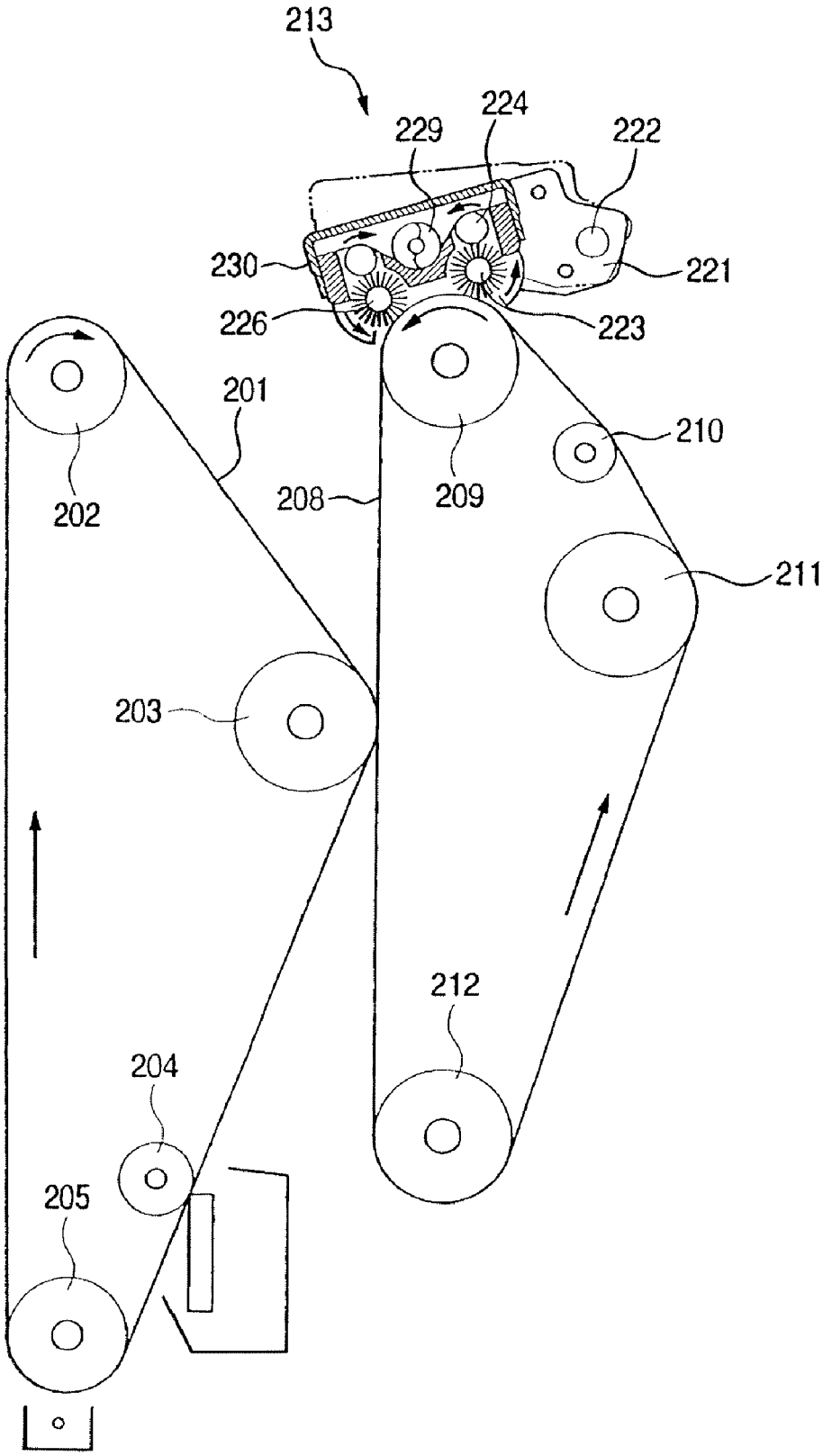
FIG. 12 PRIOR ART
FIG. 12 illustrates another conventional cleaning means.

The present invention is not restricted to the above-described construction, but can also be applied to a construction shown, for example, in FIG. 10. In the construction shown in FIG. 10, the fur brush 22 is in contact with the secondary transfer roller 5. Also, this construction has a scraping member 32 for scraping off the toners adhering to the fur brush 22. A bias is applied from a fur brush power supply 31 to the fur brush 22. The secondary transfer roller 5 is electrically grounded. By the bias applied to the fur brush 22, an electric field is formed between the secondary transfer roller 5 and the fur brush 22, and the toners adhering to the secondary transfer roller 5 are electrostatically removed by the fur brush 22. Here, the secondary transfer roller 5 is adapted to be rocked with the fur brush 22 as a fulcrum.

While in the foregoing, description has been made of a case where the intermediate transfer member is the intermediate transfer belt 8 as an example, the present invention is not restricted thereto, but can also be applied to a case where an intermediate transfer drum is used as the intermediate transfer member. Again in this case, a substantially similar effect can be achieved.

This application claims priority from Japanese Patent Application No. 2004-306259 filed Oct. 20, 2004, which is hereby incorporated by reference herein.

What is claimed is:

1. An image forming apparatus comprising:

an image bearing member, which bears a toner image thereon;

toner image forming means for forming the toner image on said image bearing member;

a transferring member, which transfers the toner image borne on said image bearing member to a recording medium being moved;

a cleaning member, which electrostatically removes a toner adhering to said transferring member; and electric field forming means for forming an electric field between said transferring member and said cleaning member, wherein when a greatest length of an image formable by said toner image forming means in a direction orthogonal to a direction of movement of the recording medium is defined as L1, and a length of said transferring member is defined as L2, and a length of an area in which the electric field is formed is defined as L3, a relation of L2>L3 >L1 is satisfied.

2. An image forming apparatus according to claim 1, wherein a relation between the greatest length L1 of the image formable by said toner image forming means and the length L3 of the area in which said electric field is formed is $$L3 \geqq L0.5 \text{ (mm)}.$$

3. An image forming apparatus according to claim 1 or 2, wherein said cleaning member includes a fur brush.

4. An image forming apparatus according to claim 3, further comprising:

a collecting member, which electrostatically collects the toner from said fur brush; and a removing member, which mechanically removes the toner from said collecting member.

* * * * *

UNITED STATES PATENT AND TRADEMARK OFFICE

CERTIFICATE OF CORRECTION

PATENT NO. : 7,317,884 B2
APPLICATION NO. : 11/239101
DATED : January 8, 2008
INVENTOR(S) : Takuya Terae et al.

It is certified that error appears in the above-identified patent and that said Letters Patent is hereby corrected as shown below:

COLUMN 1:

Line 16, "clean" should read --cleans--.

COLUMN 8:

Line 58, "L4>L522 L3" should read --L4>L5>L3--.

Line 67, "reliable" should read --reliably--.

COLUMN 10:

Line 22 Claim 2, "L3≥L0.5 (mm)." should read --L3 – L1 ≥ 0.5 (mm).--.

Signed and Sealed this

Fifth Day of August, 2008

JON W. DUDAS
*Director of the United States Patent and Trademark Office*